US007773765B1

(12) United States Patent
Graber

(10) Patent No.: US 7,773,765 B1
(45) Date of Patent: Aug. 10, 2010

(54) RECTANGULAR HORN FOR VARIED ACOUSTIC DRIVERS

(76) Inventor: Curtis E. Graber, 9301 Roberts Rd., Woodburn, IN (US) 46797

( * ) Notice: Subject to any disclaimer, the term of this patent is extended or adjusted under 35 U.S.C. 154(b) by 1050 days.

(21) Appl. No.: 11/492,334

(22) Filed: Jul. 25, 2006

(51) Int. Cl.
*H04R 25/00* (2006.01)

(52) U.S. Cl. ..... 381/342; 381/340; 381/341

(58) Field of Classification Search ..... 381/337, 381/339, 340, 341, 342, 343, 345, 182, 186, 381/353, 354; 181/144, 145, 146, 147, 152, 181/159, 177, 192, 199
See application file for complete search history.

(56) References Cited

U.S. PATENT DOCUMENTS

| | | | | |
|---|---|---|---|---|
| 4,344,504 | A | 8/1982 | Howze | |
| 5,432,860 | A * | 7/1995 | Kasajima et al. | 381/340 |
| 6,393,131 | B1 * | 5/2002 | Rexroat | 381/342 |
| 6,411,718 | B1 | 6/2002 | Danley et al. | |
| 6,628,796 | B2 | 9/2003 | Adamson | |
| 6,870,942 | B1 * | 3/2005 | Graber | 381/349 |

* cited by examiner

*Primary Examiner*—Huyen D Le
(74) *Attorney, Agent, or Firm*—Paul W. O'Malley

(57) ABSTRACT

A loudspeaker assembly is described suitable for flown arrays and incorporating a horn load planar or ribbon transducer. Planer acoustic transducers have a relatively limited power output capacity. Addition of a horn suitable for an elongated source effectively amplifies the power output capacity of the planar devices.

12 Claims, 6 Drawing Sheets

RECTANGULAR HORN FOR VARIED ACOUSTIC DRIVERS

BACKGROUND OF THE INVENTION

1. Technical Field

The invention relates to loud speaker horns and more particularly a horn accommodating planar type electro-acoustical devices or linear arrays of transducers.

2. Description of the Problem

Large space, public sound systems rely on a combination of loudspeaker types to achieve efficiency, wavefront coherence, a broad and level audio frequency bandwidth and good coverage of an audience located in the space. A foundational element in many such public sound systems is a line array of multi-transducer loudspeakers. A line array, in its classical form, consists of a vertical row of "closely spaced", cone type, direct radiator acoustical drivers set in a baffle. In this arrangement adjacent acoustical drivers are mutually coupled to reduce the spread of the sound in the plane comprising the axis of alignment of the drivers and to promote even diffusion of the sound energy in an expanding half cylinder having the axis of alignment as its center. Since line arrays are typically oriented with the axis of alignment vertical. Hence, in this patent the term "vertical" should be taken as corresponding to the axis of alignment of the speakers, or center axis of a planar type device.

Mutual coupling of the acoustic drivers results from the acoustic drivers being identical, producing the same sounds and being closely spaced. What constitutes "closely spaced" is a function of the highest audio frequency that the array is intended to produce, but roughly means that the center of each speaker cone should be spaced from adjacent cones by no more than a quarter wavelength of the highest frequency sound the array is intended to reproduce. Audible sound ranges in wavelengths from about 17 meters at 20 hertz to 1.7 cm at 20 Kilohertz. The smallest direct radiator speakers used are usually on the order 10 cm. allowing sound reproduction up to about or a little greater than 3 Kilohertz. This provides for good speech intelligibility but is less suitable for amplification of music into large spaces.

Another type of electro-acoustic transducer is the planar, or ribbon, type device, which operates like a line array with no spacing between transducer centers. These devices are thus capable of reproducing the highest human discernable frequencies while keeping the sound field compression characteristics of a linear/line array. Ribbon type audio transducers date back to the early twentieth century. An example of an early ribbon type audio transducer is disclosed in U.S. Pat. No. 1,809,754 for an "Electrostatic Reproducer" to Steedle. Ribbon devices resemble an elongated flat panel and produce sound from a vibrating flat surface. In effect a ribbon or planar is a line array of infinitesimal elements positioned directly adjacent one another, i.e. a line array having zero spacing between mutually coupled drivers. This in turn means that a planar has no practical upper frequency limit in the human audio range. Unfortunately, as observed by Adamson in U.S. Pat. No. 6,343,133, ribbon tweeters have had limits in sensitivity and power handling capacity preventing application of the devices in replacing high frequency compression drivers in systems for large spaces. Planars can also suffer from selective frequency cancellation due to out of phase reflection issues from the mounting enclosure used in linear array units.

Due in part to the perceived problems with planars, several attempts have been made to produce a device that behaves like a planer but is constructed using horn loaded, conventional mid or high frequency drivers. Such a device is usually intended to be used to reproduce sound over a broad frequency range. Precursors to and examples of these devices are represented by U.S. Pat. Nos. 4,344,504 to Howze, 5,163,167 to Heil, 6,343,133 to Adamson, and 6,394,223 to Lehman. The proposed systems have obtained some of the performance, high frequency fidelity and efficiency gains of a planar and some have incorporated rectangular waveguide.

Another approach to obtaining a sound reproduction system having a broad bandwidth is that of U.S. Pat. No. 6,411,718 for Sound Reproduction Employing Unity Summation Aperture Loudspeakers. Here a pyramid-shaped loudspeaker (essentially a rectangular section horn where all four sides have a straight conic profile) is used to allow inclusion of a plurality of loudspeaker types to produce a coherent point source. The highest frequency loudspeaker is placed at the pyramid's apex and lower frequency loudspeakers are introduced progressively along the pyramid toward the mouth of the horn, which corresponds positionally to the pyramid's base. The '718 patent discusses reasons for using a straight flare rather than a more conventional exponential or hyperbolic flares, explaining that the "slowing" flare rate is "suitable for a lower frequency" where the throat of a loudspeaker is located relatively close to the mouth.

SUMMARY OF THE INVENTION

According to the invention there is provided a loudspeaker system comprising a rectangular horn having a rectangular throat, a rectangular mouth and a first pair of opposed sides exhibiting a tractix exponential flare. A planar electro-acoustic transducer disposed lengthwise in the throat of the rectangular horn. The first pair of opposed sides end in rounded edges where they form two sides of the mouth. The planar electro-acoustic transducer may be fitted to a finite curve lengthwise. Where this is done, the rectangular horn also conforms to the finite curve of the planar electro-acoustic transducer. First and second line arrays of discrete acoustic transducers may be placed opposite one another in the first pair of opposed sides of the rectangular horn.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
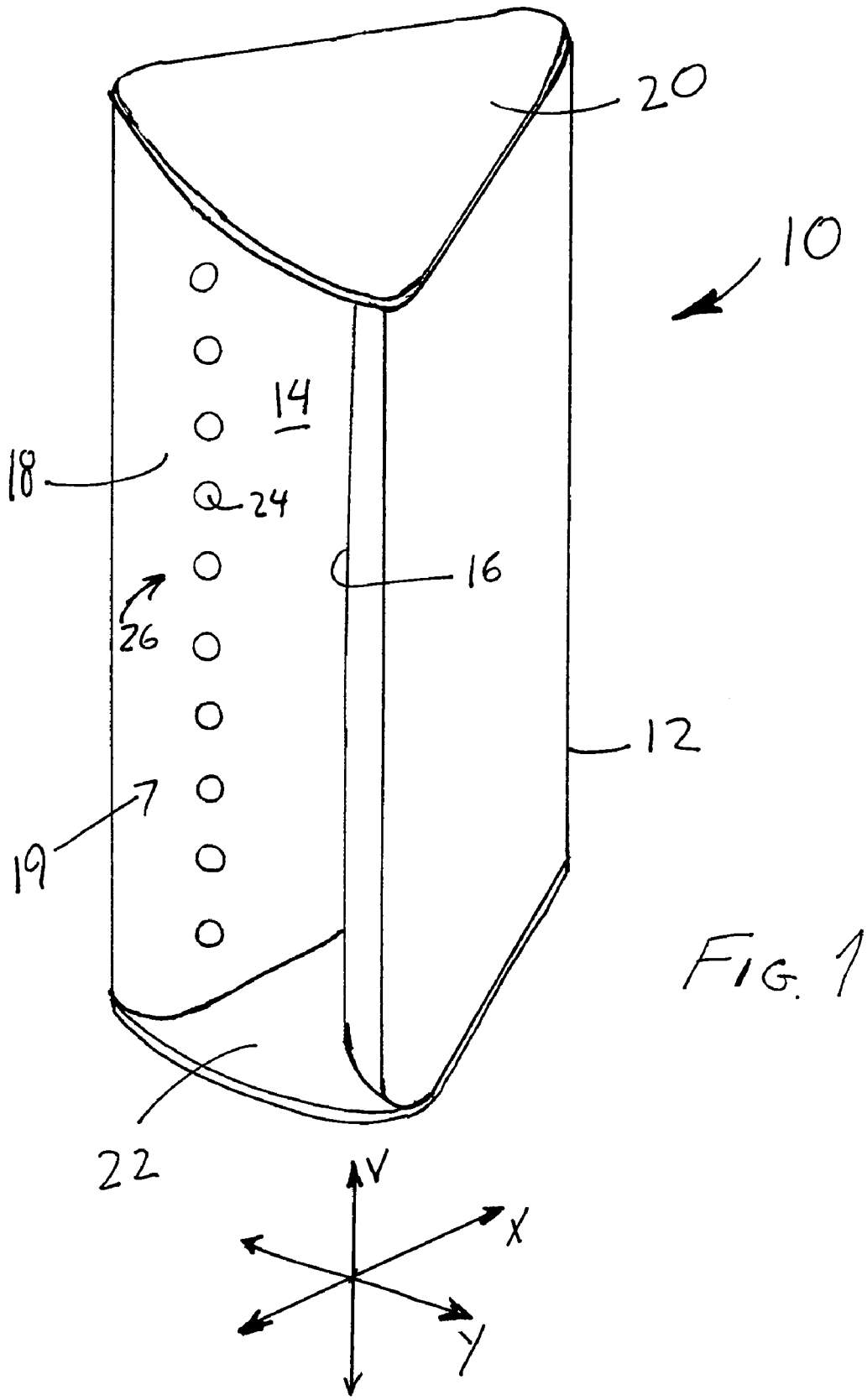
FIG. 1 is a perspective view of a tractix flare rectangular horn in a housing for a planar acoustical driver according to the invention.

Referring now to the figures and in particular to FIG. 1, a loudspeaker module 10 in accordance with the invention is shown. In describing loudspeaker module 10 reference is occasionally made to a coordinate system X, Y and V with V referring to the "vertical" and X-Y referring to a horizontal plane. This should be understood to be a matter of convention. Loudspeaker module 10 is intended for application in systems that would commonly use a line array. Line arrays are conventionally "flown" so that the long dimension of the array hangs vertically and the sound field of the system is compressed vertically. However, there is no reason why such devices cannot be oriented to place the long dimension flat with respect to the ground other than they are not typically so employed.

Loudspeaker module 10 is based on a wedge shaped housing 12 which defines a rectangular horn 14. Rectangular horn 14 has, as the name implies, two pairs of opposed walls defining the horn such that vertical section taken anywhere along the horn is approximately rectangular, disregarding for the moment the slight curvature which may be applied to the housing 12. A first pair of vertical (i.e. the longer) sides 16 and 18 conform to an exponential tractix (sometimes spelled "tractrix") flare from the throat of the horn to its mouth 19. Built into the sides 16, 18 in opposed positions are line arrays 26 (only that in side 18 shown) of loudspeakers, which are located relatively close to mouth 19 of the horn 14. The loudspeakers 28 of the line arrays 26 are conventional, relatively low frequency cone speakers, which are coupled to the environment by restricted portals 24. The top and bottom of horn 14 are closed by straight walls 20, 22. In other words, the top and the bottom sides of horn 14 are not required to flare. A small conic flare with 5 or 15 degrees of relative flare may be used in some stacks of housings 12 to produce curved arrays. Linear arrays 26 may or may not be incorporated into a module 10.

Figure 2:
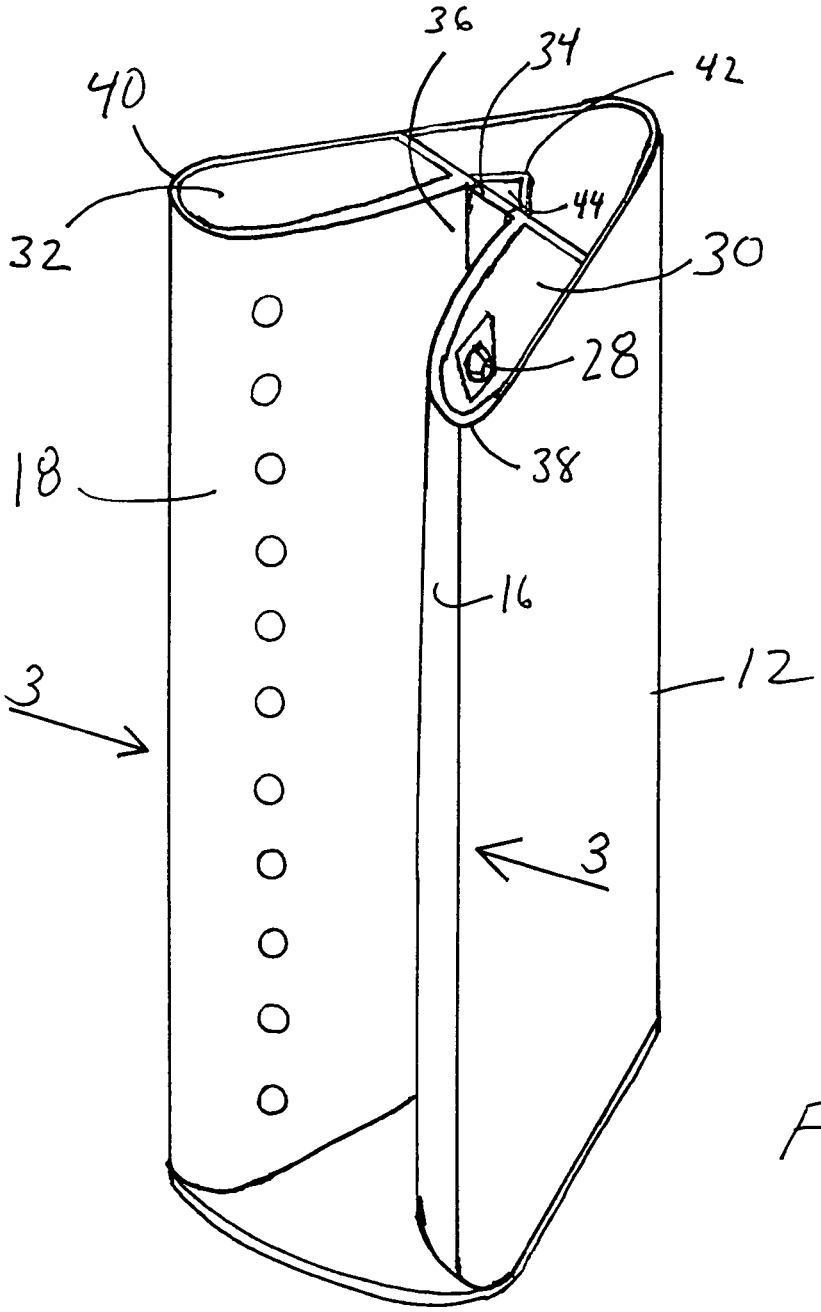
FIG. 2 is a perspective view of the housing of FIG. 1 with a top panel removed to better illustrate construction of the unit.
Figure 3:
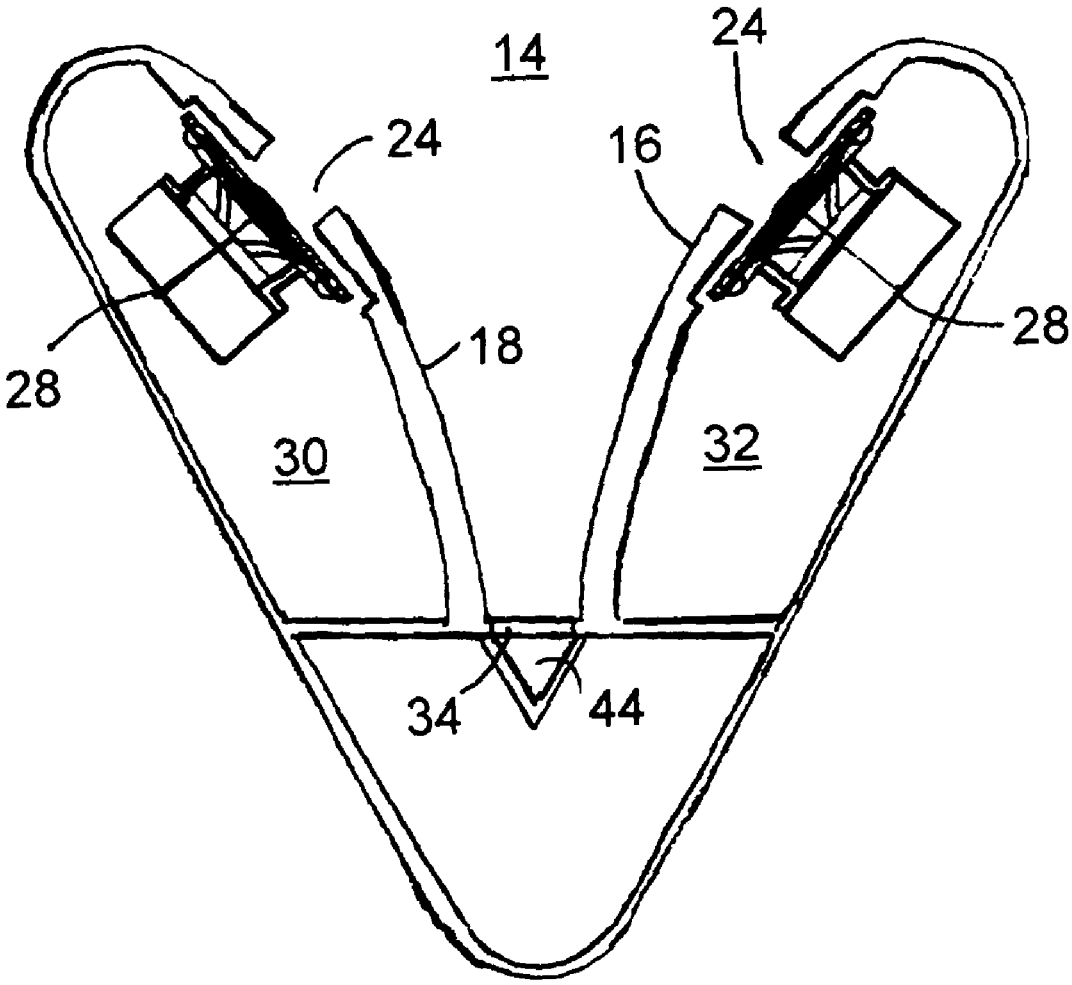
FIG. 3 is a cross sectional view of the housing of FIG. 1 taken along section lines 3 in FIG. 2.

Referring to FIG. 2, upper straight wall 20 is shown removed to reveal some of the internal compartmentalization of housing 12. Loudspeakers 28 are located in simple enclosures 30, 32 located behind flared side walls 16 and 18. Side walls 16 and 18 have radiused ends 38, 40 defining the mouth 19 of horn 14. This avoids an abrupt boundary condition at the mouth 19 between the flare and the environment. A planar of ribbon type acoustical transducer 34 is located across the throat 36 of horn 14. Planar 34 is oriented with its longer dimension turned vertically to run from the top to the bottom of the horn parallel to the linear arrays 26. Planer 34 may of course be a plurality of discrete devices operating synchronously. Planar is set over a standing wave cancelling tuned cavity 44 (shown in FIG. 3) defined by a wedge shaped wall 42.

Figure 4:
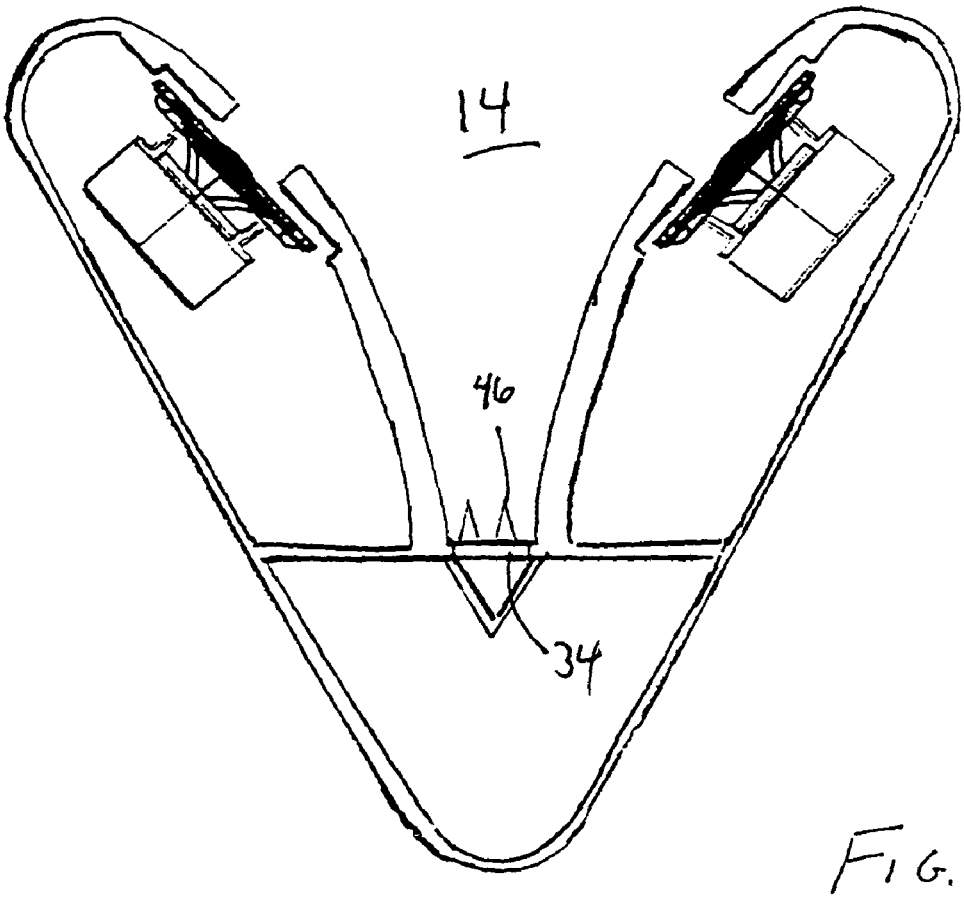
FIG. 4 is a modification of the embodiment illustrated in FIG. 3 to include phase plugs for the planar driver.

Referring to FIG. 4 it may be seen that phase wedges 46 may be extend from the forward face of planar into the throat of horn 14.

Figure 5:
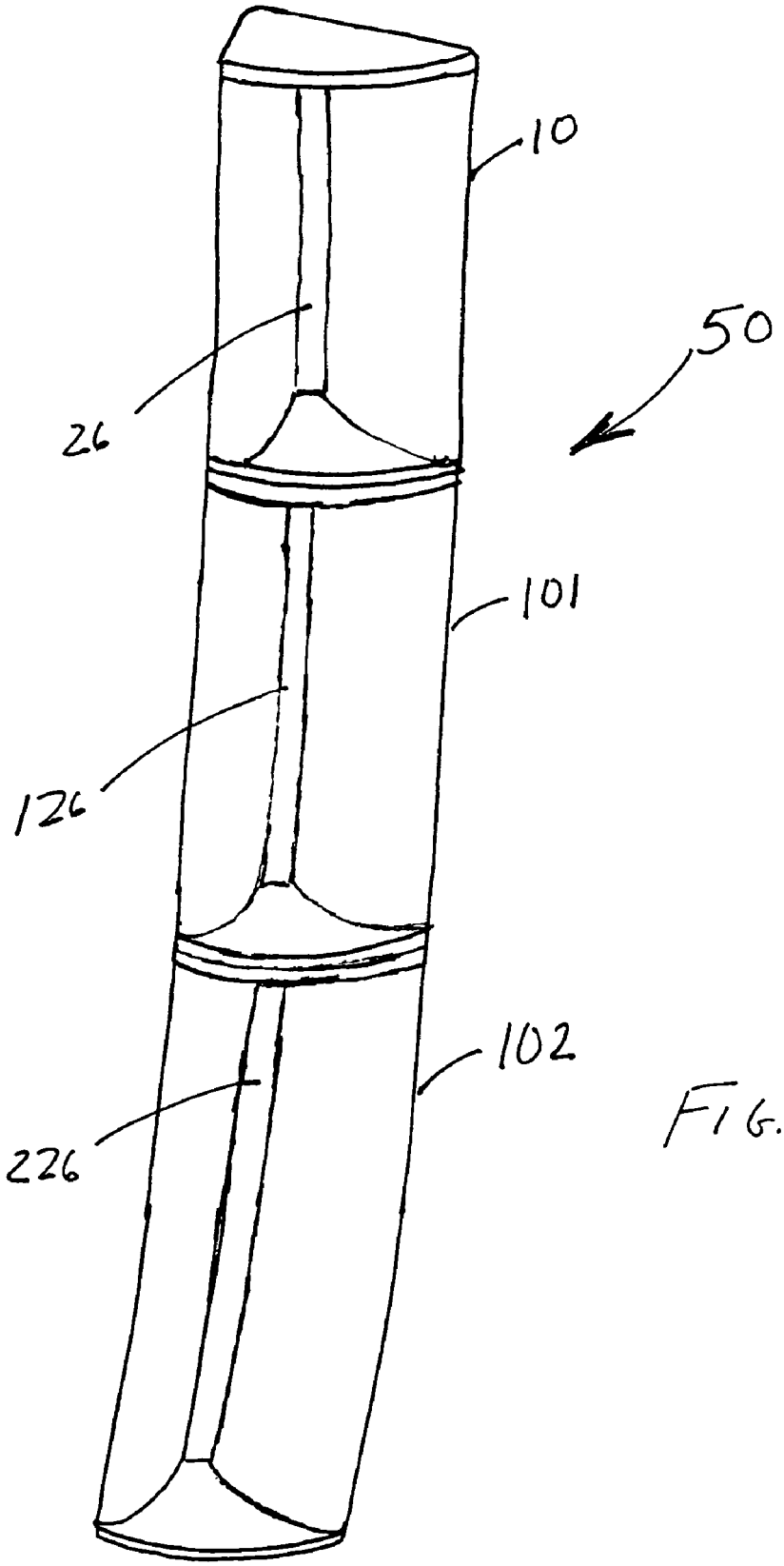
FIG. 5 is a perspective view of flying array of modules incorporating tractrix flares.
Figure 6:
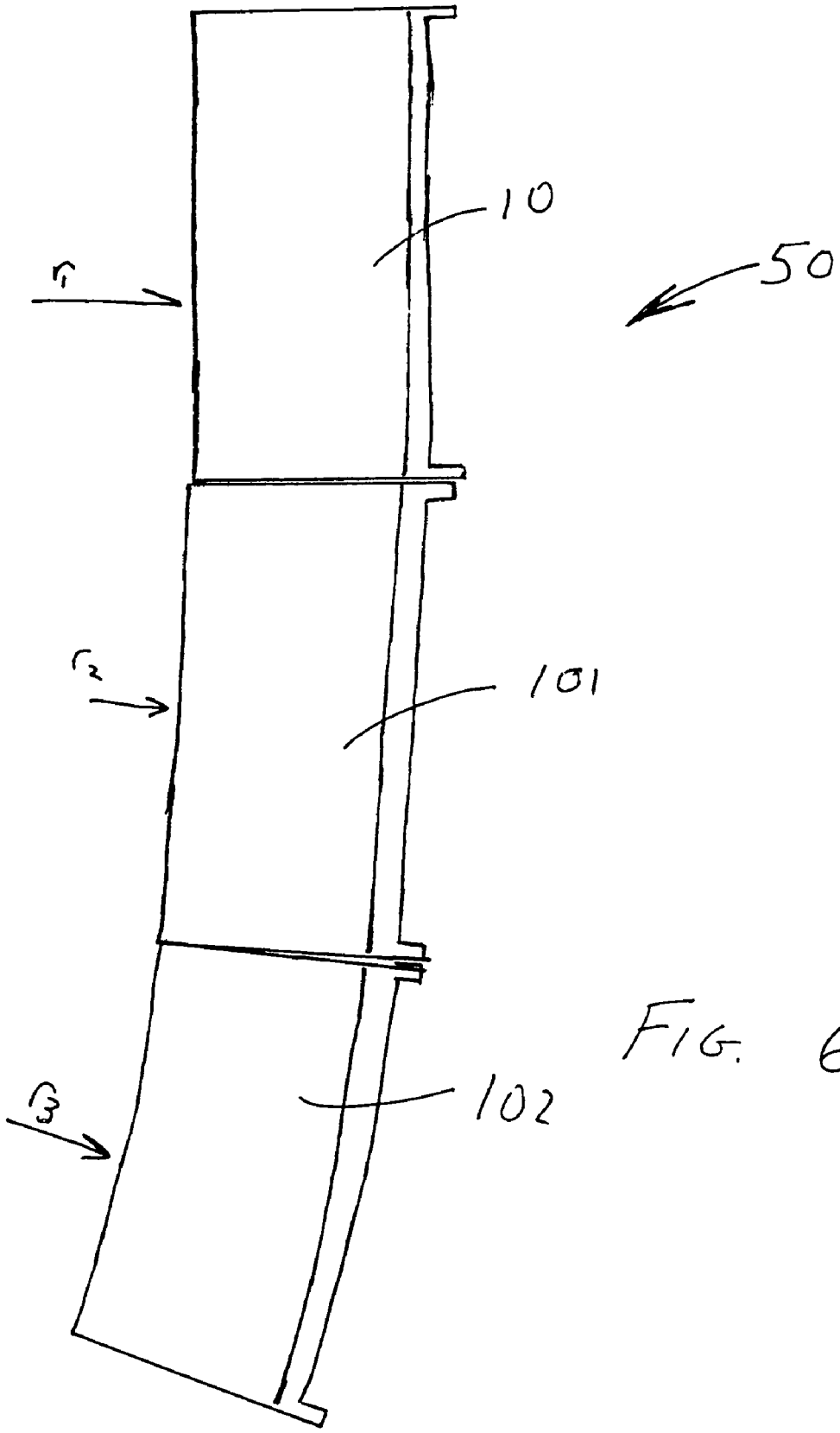
FIG. 6 is a side elevation of the array of FIG. 6.

Referring to FIGS. 5 and 6, a flying assembly 50 of modules is shown, suitable for coverage of a large area. Three individual modules 10, 101 and 102 incorporate ribbon transducers 26, 126, 226, which exhibit progressively tighter radii of curvature and which are roughly aligned end to end. Flying assemblies of linear arrays are of course known in the art, however, the present invention, making use of straight, continuously curved and potentially progressively curved planars provide nearly boundary free coverage of almost any area. As illustrated in FIG. 6, moudles 10, 101, 102 each are built on progressively smaller radii r1, r2, r3.

The present invention incorporates ribbon tweeters in a line array and amplifies the power output of the sound by providing a tractrix flared horn. Smooth, nearly boundary free coverage of an area is provided.

While the invention is shown in only one of its forms, it is not thus limited but is susceptible to various changes and modifications without departing from the spirit and scope of the invention.

What is claimed is:

1. A loudspeaker system comprising:

a rectangular horn having a rectangular throat, a rectangular mouth and a first pair of opposed sides exhibiting an hyperbolic or exponential flare;

first and second line arrays of discrete acoustic transducers disposed in the first pair of opposed sides of the rectangular horn, the first and second line arrays being located parallel to one another, displaced from the rectangular throat, equidistant from the rectangular mouth and tangential to opposed sides locally to be partially directed out of the rectangular mouth; and a planar electro-acoustic transducer having a direction of elongation disposed across the rectangular throat parallel to the first and second arrays in its direction of elongation.

2. A loudspeaker system as set forth in claim 1, further comprising:

the first pair of opposed sides each terminating in a radius where they meet the mouth.

3. A loudspeaker system as set forth in claim 2, further comprising:

the planar electro-acoustic transducer being fitted to a finite curve lengthwise; and the rectangular horn conforming to the finite curve of the planar electro-acoustic transducer.

4. A loudspeaker system as set forth in claim 3, further comprising:

simple enclosures backing the first and second line arrays, respectively.

5. A loudspeaker system as set forth in claim 4, further comprising:

a standing wave canceling tuned enclosure backing the planer acoustical transducer.

6. A modular sound reproduction system allowing essentially indeterminate extension, the modular sound reproduction system comprising:

an elongated housing defining a rectangular horn with a throat and a mouth, and first and second pairs of opposed sides;

a planar acoustical loudspeaker located across the throat of the rectangular horn aligned on the direction of elongation of the elongated housing;

the first pair of opposed sides extending outwardly from long edges of the throat with an exponential or hyperbolic flare; and first and second line arrays of discrete acoustic transducers disposed in the first pair of opposed sides of the elongated housing parallel to one another, displaced from the throat, equidistant from the mouth and tangential to the opposed sides locally to be partially directed out of the mouth.

7. A modular sound reproduction system as set forth in claim 6, further comprising:

a plurality of the elongated housings with planar acoustical loudspeakers, the elongated housings being located end to end to bring the planar acoustical loudspeakers into alignment.

8. A modular sound reproduction system as set forth in claim 7, further comprising:

the first pair of opposed sides each terminating in a radius where they meet the mouth.

9. A modular sound reproduction system as set forth in claim 8, further comprising:

the planar electro-acoustic transducer being fitted to a finite curve lengthwise; and the rectangular horn conforming to the finite curve of the planar electro-acoustic transducer.

10. A modular sound reproduction system as set forth in claim 9, further comprising:

the finite curve having a progressively smaller radius from one end to another.

11. A modular sound reproduction system as set forth in claim 10, further comprising:

simple enclosures backing the first and second line arrays, respectively.

12. A modular sound reproduction system as set forth in claim 11, further comprising:

a standing wave canceling tuned enclosure backing the planer acoustical transducer.

* * * * *